US006514155B1

(12) United States Patent
Sheets

(10) Patent No.: US 6,514,155 B1
(45) Date of Patent: Feb. 4, 2003

(54) GOLF CLUB WITH CURVED SHAFT

(75) Inventor: Jeffrey D. Sheets, Aurora, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 09/710,074

(22) Filed: Nov. 10, 2000

(51) Int. Cl.[7] ..... A63B 53/00; A63B 53/02
(52) U.S. Cl. ..... 473/314; 473/316
(58) Field of Search ..... 473/314, 324, 473/316, 317, 318, 319, 320, 321, 322, 323, 340, 341

(56) References Cited

U.S. PATENT DOCUMENTS

| | | | | |
|---|---|---|---|---|
| 2,926,913 | A | | 3/1960 | Stecher |
| 3,166,320 | A | * | 1/1965 | Onions |
| 3,539,184 | A | | 11/1970 | Koorland |
| D303,132 | S | | 8/1989 | Muta |
| 5,106,088 | A | | 4/1992 | Saito |
| 5,338,029 | A | | 8/1994 | Falzone |
| 5,465,959 | A | | 11/1995 | Cheng |
| 5,470,070 | A | * | 11/1995 | Bendo |
| 5,497,992 | A | | 3/1996 | Ritke |
| 5,569,098 | A | * | 10/1996 | Klein |
| 5,624,329 | A | | 4/1997 | Schneebeli |
| 5,720,672 | A | | 2/1998 | Smith |
| 5,746,665 | A | | 5/1998 | Wenker |
| 5,803,824 | A | * | 9/1998 | Rollingson |
| 5,885,166 | A | * | 3/1999 | Shiraishi |
| 5,928,089 | A | | 7/1999 | Smith |
| 5,931,741 | A | | 8/1999 | Fenton, Jr. |
| 6,033,320 | A | * | 4/2000 | Bamberger |
| 6,083,115 | A | | 7/2000 | King |
| 6,358,162 | B1 | * | 3/2002 | Piotrowski |

* cited by examiner

*Primary Examiner*—Stephen Blau

(57) ABSTRACT

A golf club includes a clubhead and a curved or bent shaft which has a tip end which extends at an angle relative to the remainder of the shaft. The tip end of the shaft is attached to a hosel on the clubhead and extends upwardly and forwardly from the clubhead. The upper end of the shaft extends away from the clubhead to provide the lie angle of the club. The angled tip end moves the upper end of the shaft forwardly relative to the center of gravity of the clubhead, and increases the ability to rotate the face of the clubhead back to a square position during the golf swing.

4 Claims, 14 Drawing Sheets

USGA Rules Of Golf Equipment - Appendix II

** Heel/Toe impact points are .6875' away from Center

** Heel/Toe impact points are .6875' away from Center

GOLF CLUB WITH CURVED SHAFT

BACKGROUND AND SUMMARY OF THE INVENTION

This invention relates to golf clubs, and more particularly, to a golf club with a bent or curved shaft. Conventional golf club shafts are straight. A straight shaft has only one rotational axis. When a golf club impacts a golf ball, the clubhead and the shaft tend to rotate about the longitudinal axis of the shaft. Rotation of the clubhead decreases the accuracy of the shot.

The invention provides a golf club with a bent or curved shaft. The shaft includes a relative long butt portion and a relatively short tip portion which extends at an angle to the butt portion. The tip portion is attached to the hosel of the clubhead and extends forwardly and upwardly relative to the face of the clubhead. The butt portion extends away from the clubhead at an angle to a horizontal ground plane to establish the lie angle of the club.

The curved shaft has two axes, which increase the torsional stability of the clubhead. The axis of the tip extends forwardly from the face of the clubhead and therefore has a component which extends in the same direction as the impact force which is applied to the face by the golf ball. The tip portion therefore has less tendency to rotate about its axis and thereby reduces the twist or torque of the butt portion.

The angled tip portion also moves the axis of the butt portion forwardly relative to the center of gravity of the clubhead. It is therefore easier to rotate the clubface back to a square position during the golf swing.

DESCRIPTION OF THE DRAWING

The invention will be explained in conjunction with illustrative embodiments shown in the accompanying drawing, in which.

DESCRIPTION OF SPECIFIC EMBODIMENTS

Figure 1:
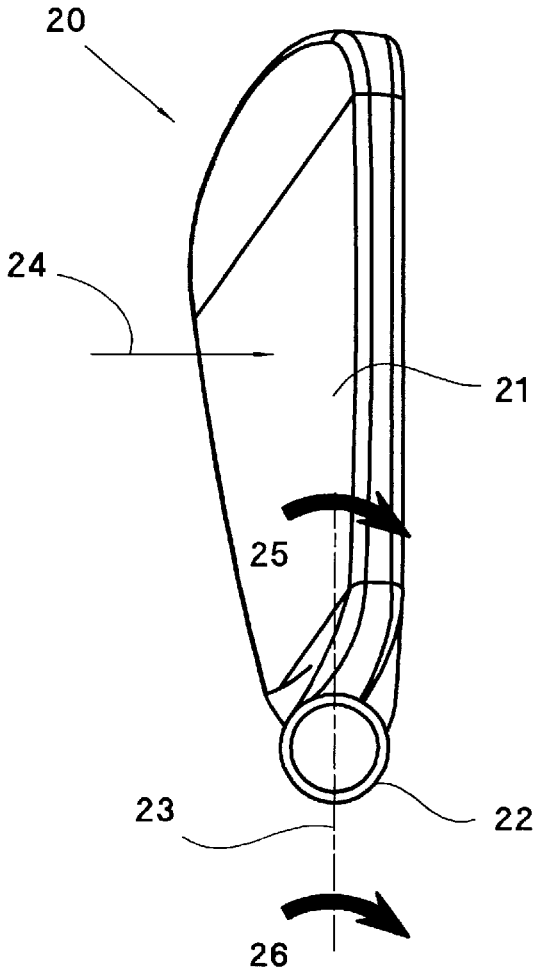
FIG.1 PRIOR ART
FIG. 1 is a top view of a conventional prior art golf club with a straight shaft.

FIG. 1 illustrates a conventional iron golf club 20 which includes a clubhead 21 and a straight shaft 22. The shaft has a longitudinally extending axis of rotation 23. When the clubhead impacts a golf ball, a force is imparted on the clubhead in the direction of arrow 24.

Figure 3:
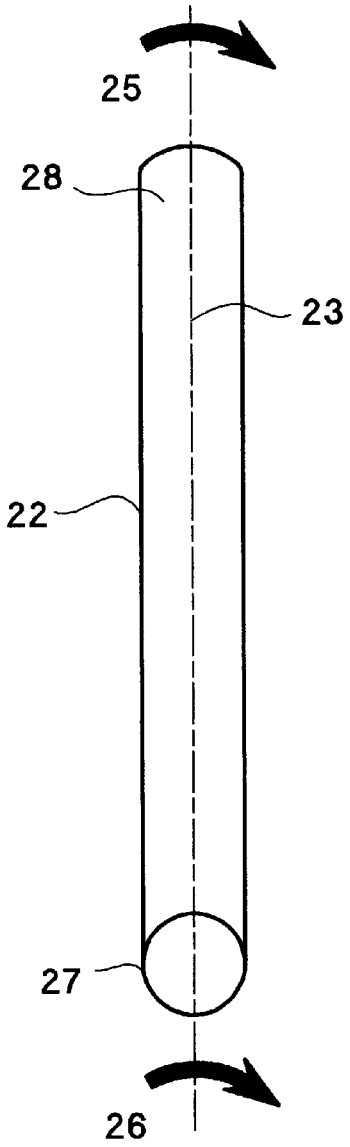
FIG.3 PRIOR ART
FIG. 3 is a diagrammatic illustration of twisting forces on a conventional straight shaft.

FIG. 3 is a diagrammatic illustration of the forces of FIG. 1. The shaft 22 includes a butt end 27 and a tip end 28 which is attached to a hosel of the clubhead 29. The rotational forces 25 and 26 which are exerted on the tip and butt ends of the shaft are resisted by the torsional resistance of the shaft. For a straight shaft, the torsional resistance is similar at both the tip end and the butt end, although the larger diameter of the butt end provides greater torsional resistance.

The rotational forces cause the shaft to twist between the tip end and the butt end, which is held by the golfer. The amount of twist in degrees under a predetermined rotational force is referred to as the torque of the shaft. Higher torque numbers mean greater twist and less resistance to torsion.

Figure 2:
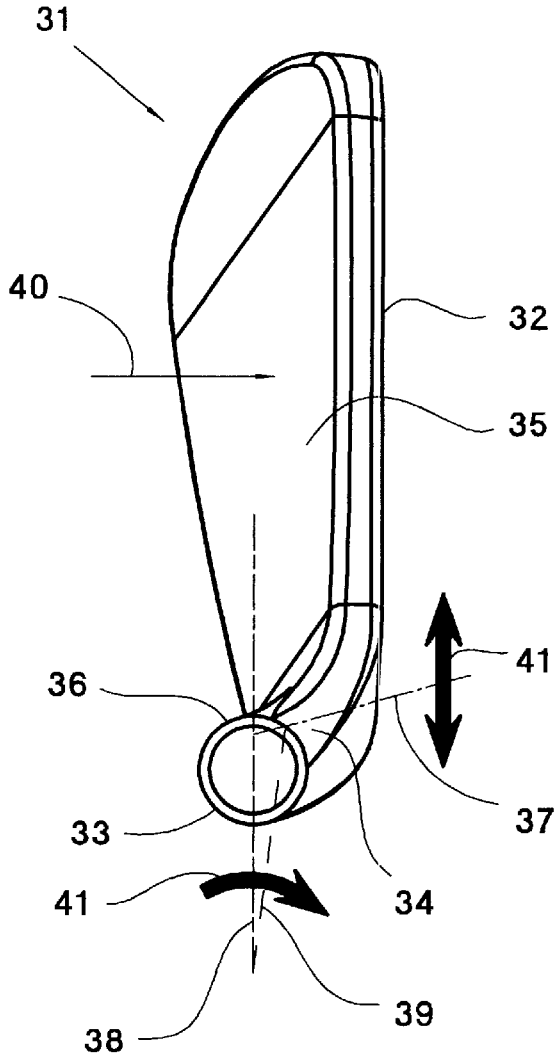
FIG. 2 is a top view of a golf club with a bent or curved shaft in accordance with the invention.

FIG. 2 illustrates a golf club 31 which includes a clubhead 32 and a curved or bent shaft 33. The curved shaft includes a short tip portion 34 which is attached to the hosel of the clubhead and which extends forwardly and upwardly relative to the front striking face 35 of the clubhead. A relatively long, straight butt portion 36 extends upwardly from the tip portion. The shaft 33 has multiple axes of rotation the axis 37 of the tip portion, the axis 38 of the butt portion and a combined axis 39 between the tip and butt ends.

A force 40 created by an impact with a golf ball creates force 41 on the tip portion 14 of the shaft and rotational force 42 on the butt portion. Since the axis 37 of the tip portion extends forwardly from the face 35, the axis has a component which is aligned with the force 40. The amount of rotational force which is transmitted to the butt portion 36 is thereby reduced.

Figure 4:
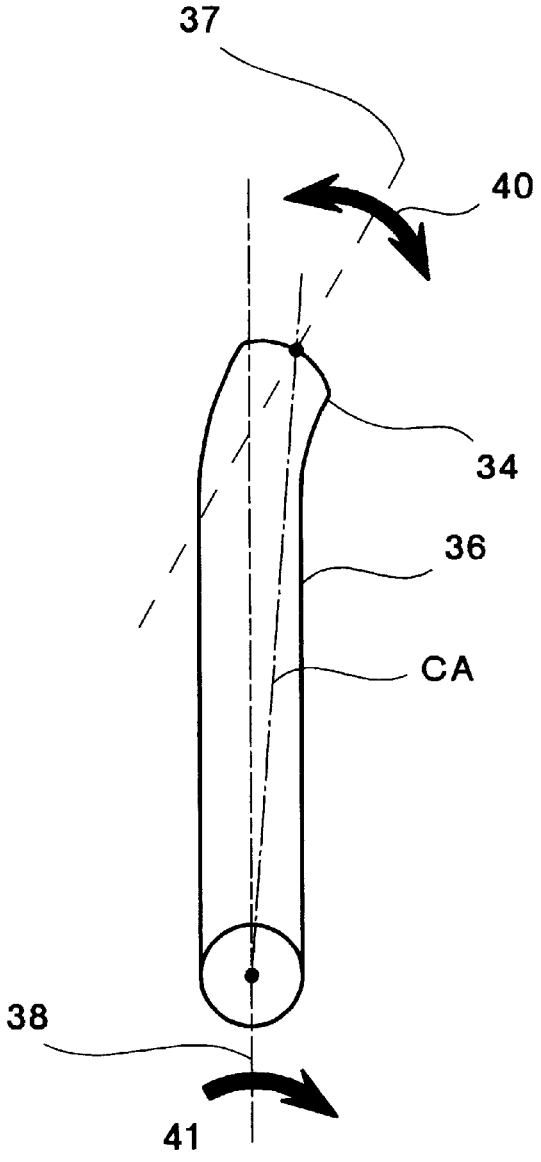
FIGS. 4–6 are diagrammatic illustrations of twisting forces on curved shafts.
Figure 5:
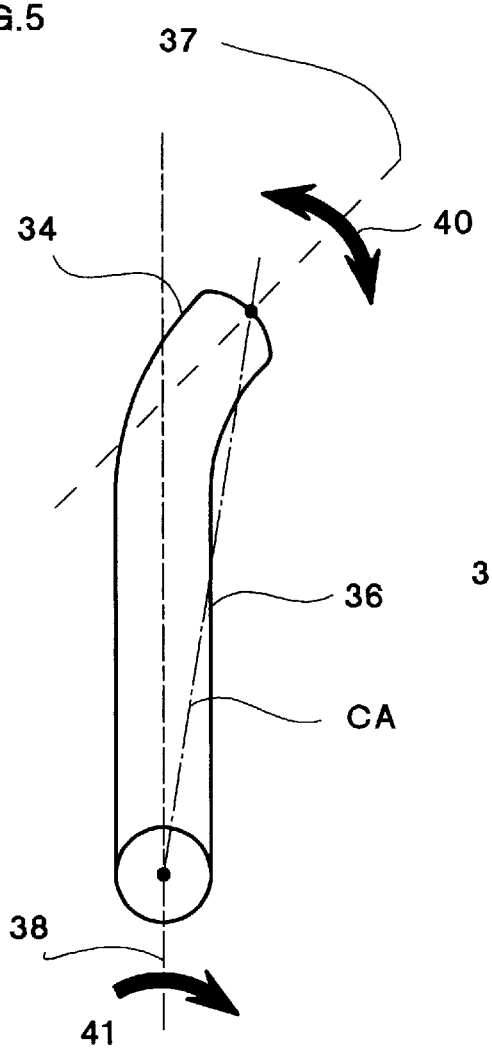
Figure 6:
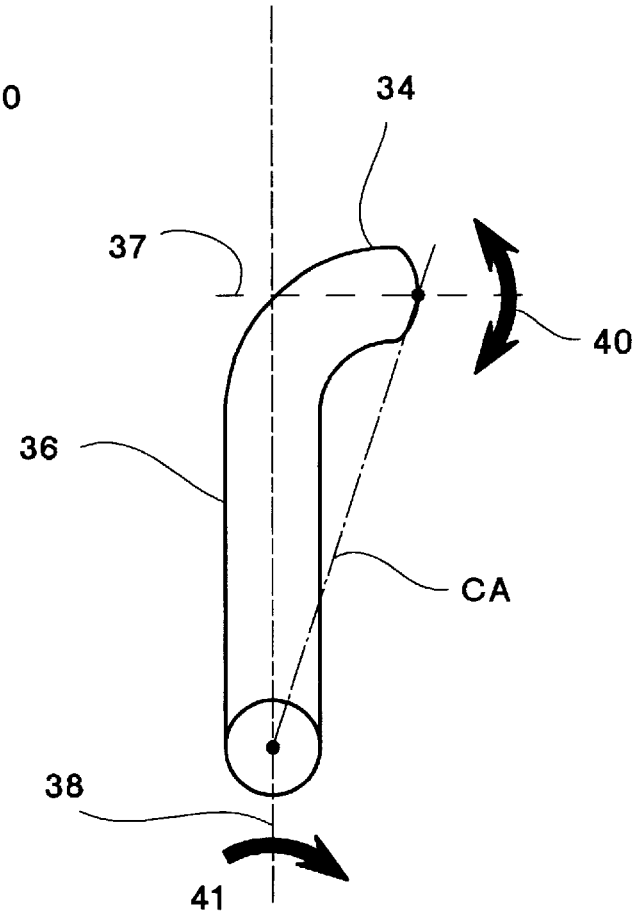

FIGS. 4–6 are diagrammatic illustrations of the forces of FIG. 2. In FIGS. 4 and 5 the tip portion 34 is attached to the hosel of a golf club and extends at an acute angle A to the butt portion 36. In FIG. 6 the axis of the butt portion extends at a right angle relative to the axis of the butt portion. Upon rotational movement of the butt end 43, the shaft rotates around its primary axis 38. Rotational movement of the tip end 34 by force 41 creates a revolution around the tip axis 37. With both the butt and tip ends in supported positions, the curved shaft will rotate around a combined axis CA, which extends between the butt and tip ends.

Figure 7:
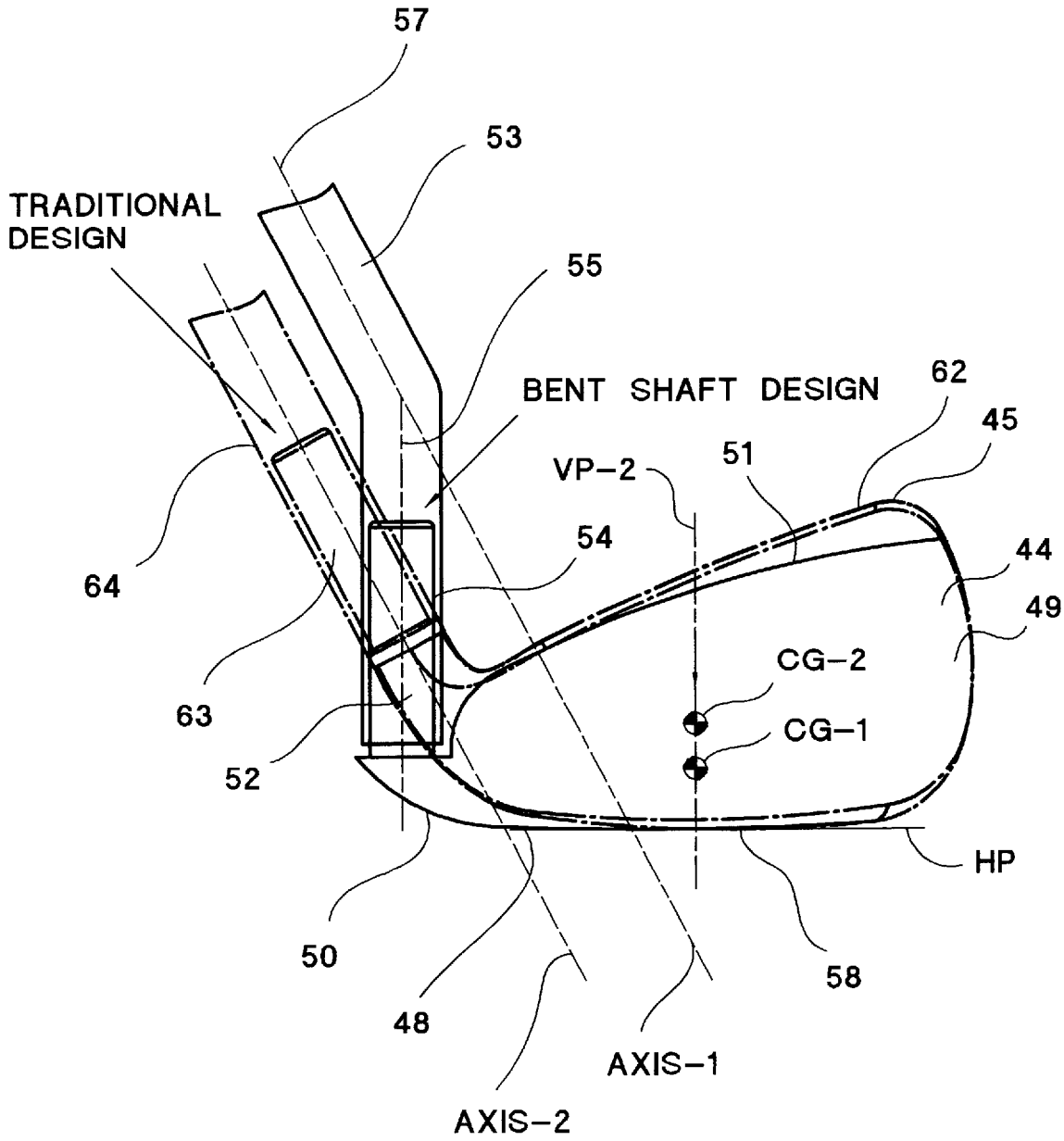
FIG. 7 is a rear view illustrating both a golf club with a conventional straight shaft and a golf club with a curved shaft and a hosel designed for that shaft.
Figure 8:
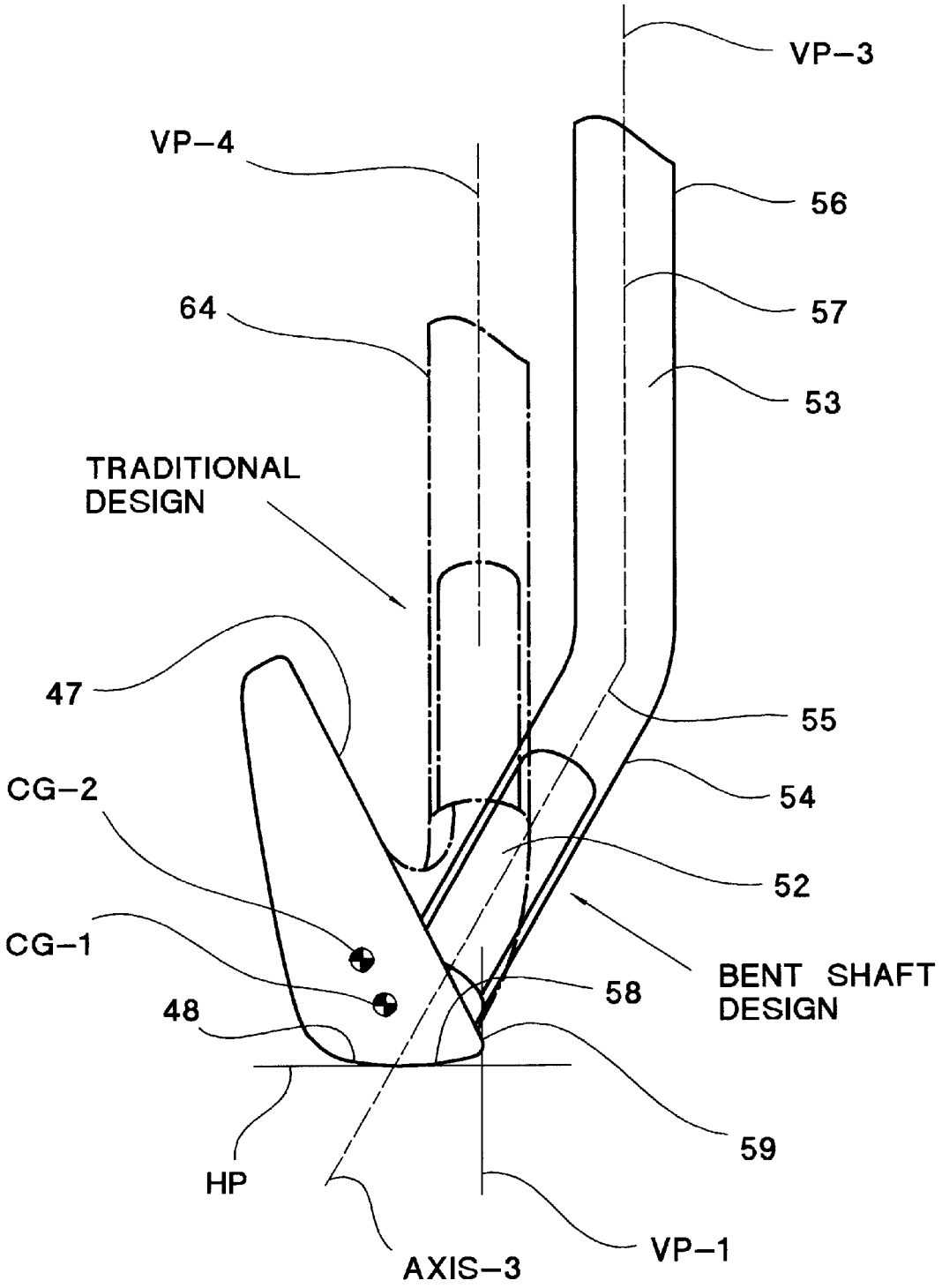
FIG. 8 is a toe end view of the golf clubs of FIG. 7.

FIGS. 7 and 8 illustrate superimposed views of a golf clubhead 44 in solid outline which is formed in accordance with the invention and a conventional golf clubhead 45 in dotted outline. The clubhead 44 has a front face 47, a sole 48, a toe portion 49, a heel portion 50, and a topline 51. A hosel 52 extends upwardly and forwardly from the face 47. A curved shaft 53 includes a tip portion 54 having an axis 55 and a butt portion 56 having an axis 57.

Golf clubheads are conventionally designed relative to a horizontal ground plane HP which is tangent to a midportion 58 of the sole when the sole is properly grounded at an address position. The conventional grooves in the face are horizontal when the clubhead is in the designed address position.

The front edge 59 of the clubhead which is formed by the intersection of the face 47 and the sole 48 is tangent at a midportion of the edge to a first vertical plane VP1. A second vertical plane VP2 extends through the center of gravity CG1 of the clubhead 44 perpendicularly to plane VP1.

The axis of the butt portion 56 of the shaft 53 lies in another vertical plane VP3 which is parallel to vertical plane VP1. Referring to FIG. 7, the angle of the axis 57 of the butt portion relative to the horizontal ground plane HP defines the lie angle of the clubhead.

The conventional clubhead 45 is similar to the clubhead 44 except that its topline 62 is higher than topline 51 and the centerline of the hosel 63 extends in a vertical plane VP4 which is spaced behind the plane VP3 in which the axis of the butt portion of the curved shaft 53 lies. A straight shaft 64 is attached to the hosel 63, and its axis lies in the plane VP4. The lie angles of the two clubs are substantially the same.

Both of the hosels 52 and 63 are male hosels, and the shafts 53 and 64 extend over the hosels. However, the invention can also be used with female hosels or other means for attaching the shaft to the clubhead.

Referring to FIG. 8, the forward extension of the tip portion 54 of the curved shaft 53 positions the butt portion 56 forwardly of the straight shaft 64. The center of gravity CG1 of the clubhead 44 is therefore positioned farther away from the butt portion 54 than the center of gravity CG2 of the clubhead 45 is spaced from the straight shaft 64.

Referring to FIG. 7, the tip portion 54 of the curved shaft 53 extends in a more upright direction than the straight shaft 64. The axis 57 of the butt portion is thereby moved toward the center of the clubhead, which reduces the moment of inertia about an Axis 1 compared to a moment of inertia about Axis 2, making it easier to rotate to clubface square. The clubhead 46 also has a lower topline 51 than the conventional topline 62, which lowers the center of gravity CG1 relative to the center of gravity CG2. In FIG. 7 the axis 57 of the butt portion 52 extends at an angle $C_1$ from the vertical, and the axis 55 of the tip portion 54 extends at a smaller angle $C_2$ from the vertical.

Figure 9:
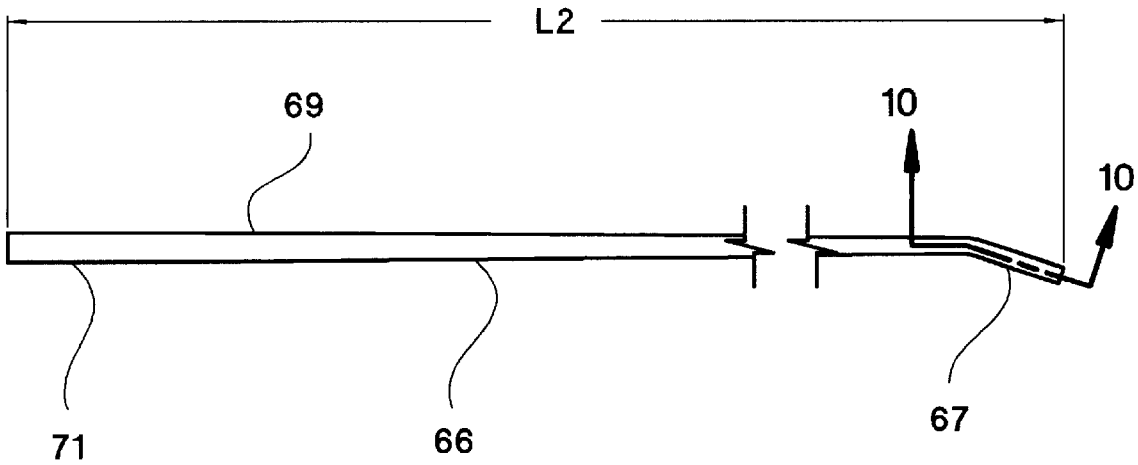
FIG. 9 illustrates a curved shaft, partially broken away, in accordance with the invention.
Figure 10:
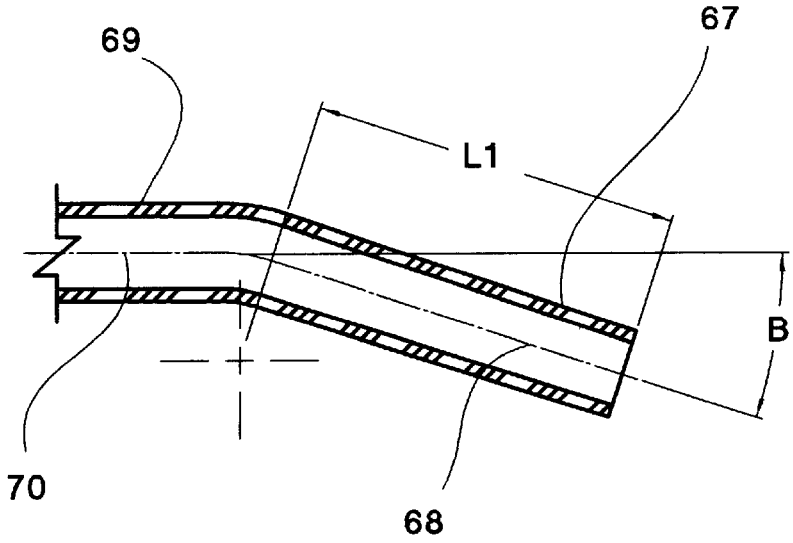
FIG. 10 is a fragmentary sectional view taken along the line 10—10 of FIG. 9.

FIGS. 9 and 10 illustrate one embodiment of a curved shaft 66. The shaft includes a short tip portion 67 having an axis 68 and a long butt portion 69 having an axis 70. The axes form an included angle B of 18°.

In the embodiment illustrated, the length L1 of the tip portion was 2.00 inch. The overall length L2 was 40 inches, and the length of the shaft for a particular club can be adjusted as desired by cutting off the butt end. The outside diameter of the tip portion was 0.480±0.005 inch, and the outside diameter of the butt end 71 was about 0.600±0.005 inch. The shaft was formed from unidirectional pre-preg graphite and epoxy composite material.

The shaft can be formed from other materials, e.g., metals such as stainless steel and aluminum, and the lengths and diameters of the tip and butt portions can vary. The angle B is preferably 18° but can vary between 1° and 90°.

Figure 11:
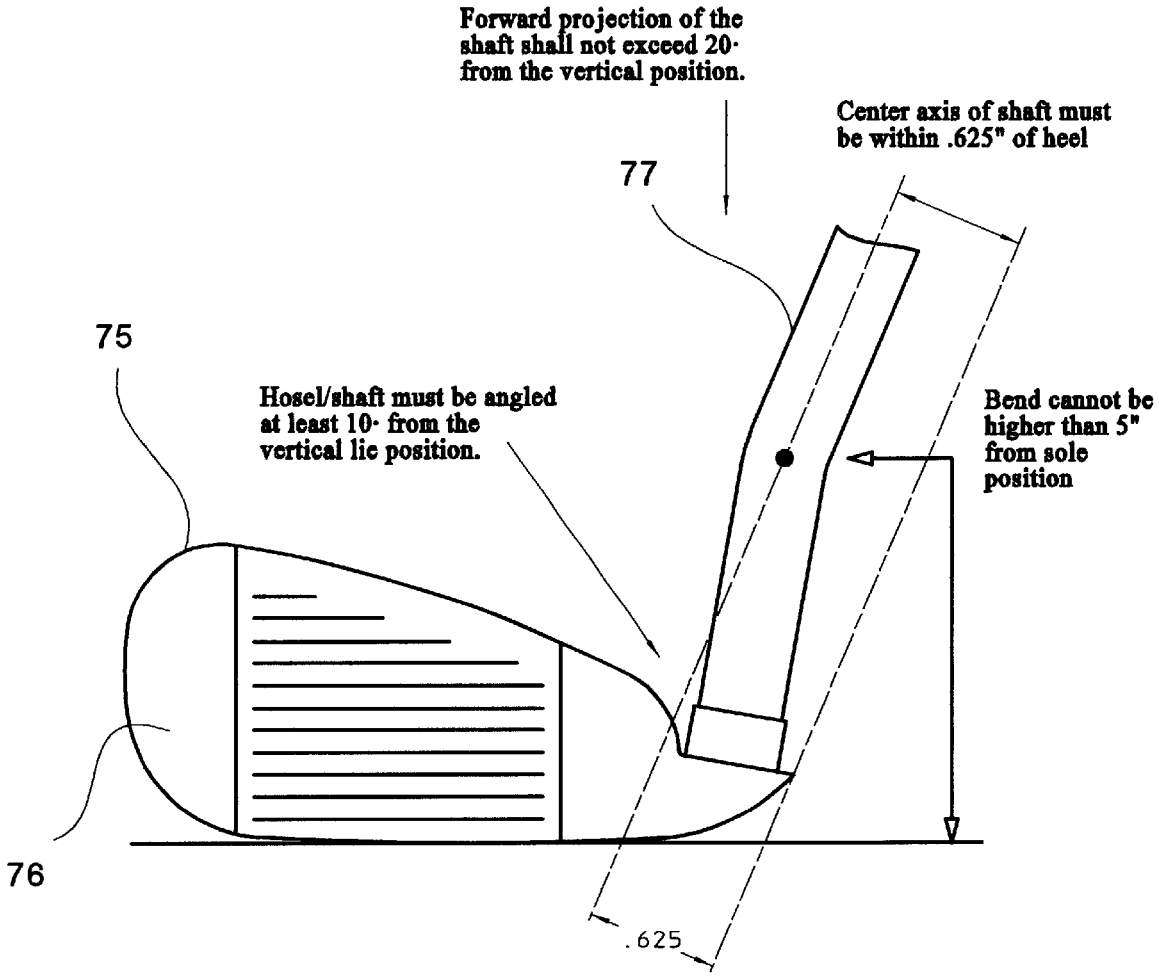
FIG. 11 is a fragmentary front view of an iron golf club formed in accordance with the invention.

FIG. 11 illustrates an iron golf club 75 which includes a clubhead 76 and a curved shaft 77. The descriptive text in FIG. 10 is based on Appendix II of the USGA Rules of Golf Equipment. The golf club 75 conforms to those Rules.

Figure 12:
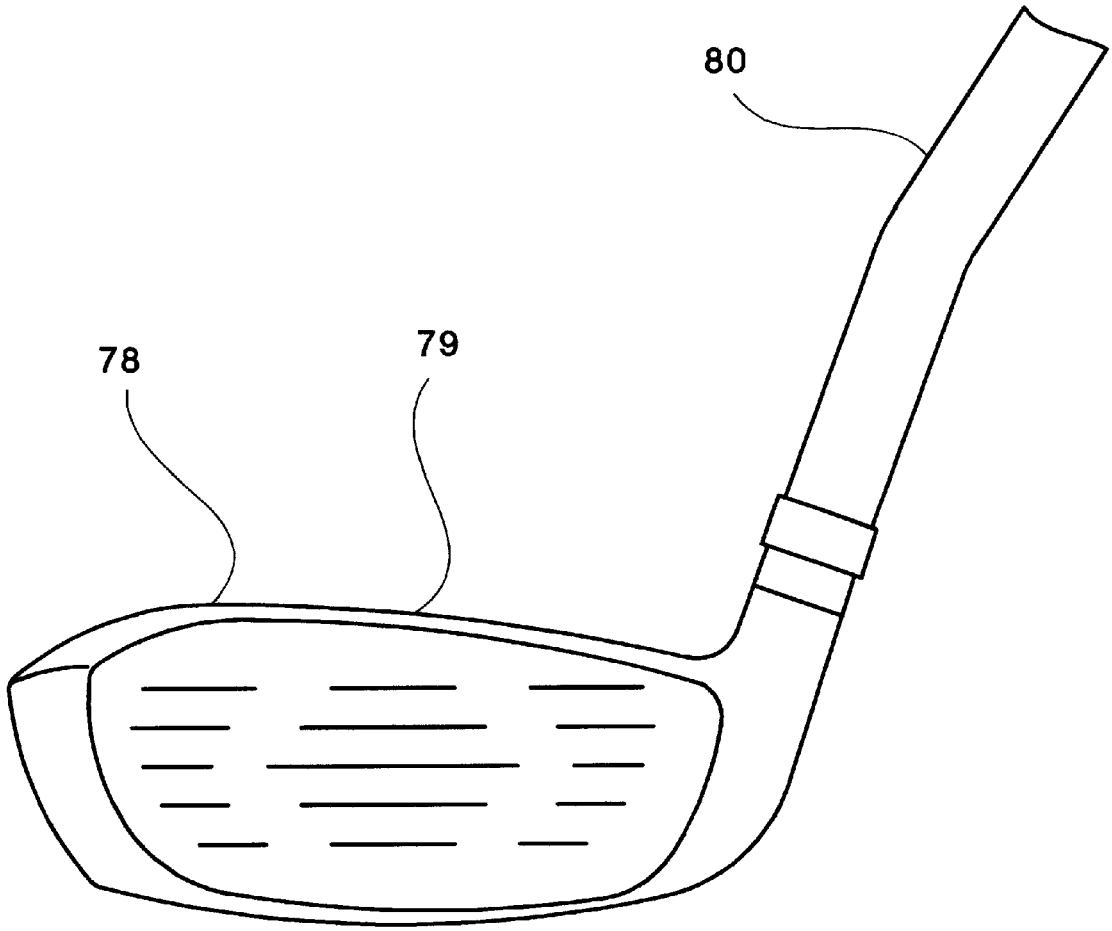
FIG. 12 is a fragmentary front view of a wood-type golf club formed in accordance with the invention.

FIG. 12 illustrates a wood-type golf club 78 which includes a clubhead 79 and a curved shaft 80. Wood-type clubheads are now conventionally formed of metal but can be formed of other materials. The golf club 78 also conforms to the Rules of Golf.

Figure 13:
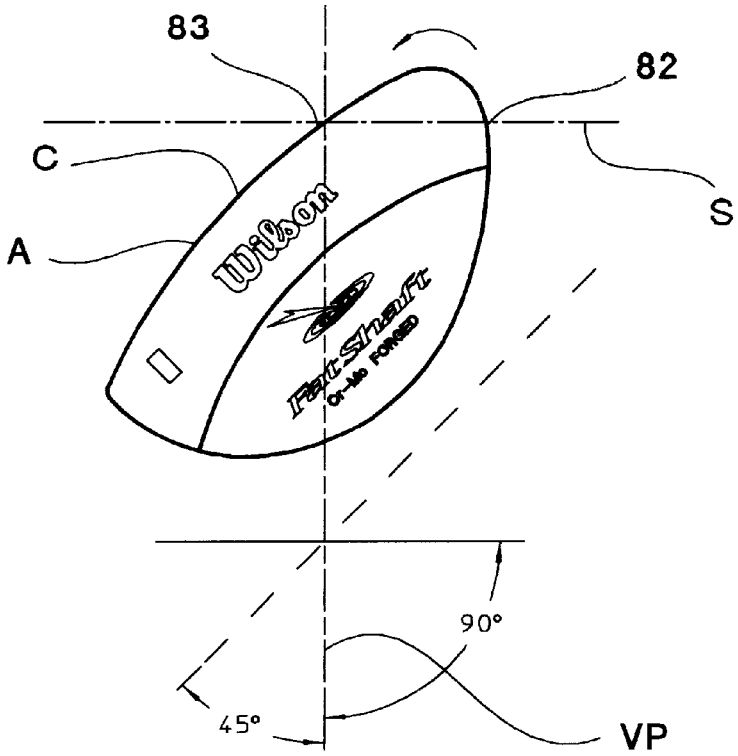
FIG. 13 is a bottom view of a golf club with a curved shaft showing the influence of the curved shaft on the angle of the center of gravity.
Figure 14:
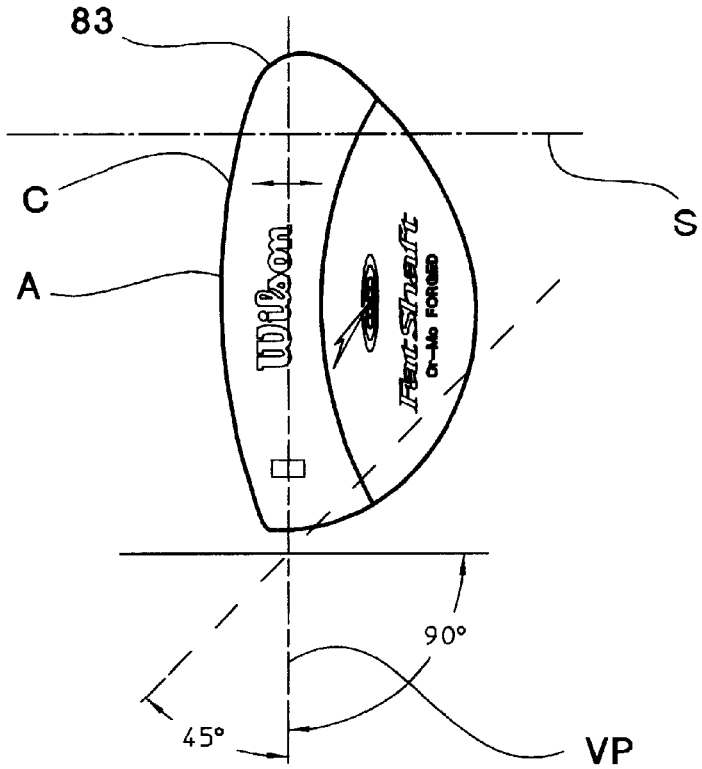
FIG. 14 is a view similar to FIG. 13 of a golf club with a straight shaft.

FIGS. 13 and 14 illustrate how the curve or bend of the shaft of a golf club influences the angle of the center of gravity. In FIG. 13 the golf club 82 has a curved shaft as illustrated in FIGS. 7–11. The straight butt portion of the shaft is supported by a horizontal surface S, and the center of gravity CG of the clubhead causes the clubhead to rotate to the position illustrated in FIG. 13.

The vertical plane VP is lined up with the centerline axis of butt portion of the shaft (primary axis). A tangent between the primary axis VP and the center of the club's leading edge C form the center of gravity (CG) Angle A. The curved shaft prevents the center of gravity CG from rotating counter-clockwise to the right of the vertical plane. The angle of the center of gravity is the angle between the vertical plane VP and a line 83 which is tangent to the leading edge of the clubhead. The greater the CG angle A, the more stable the golf club remains on off-center hits. The higher CG angle also assists the clubface with squaring up at impact, assisting less skilled golfers with a tendency to leave the clubface open, which results in slicing the ball.

Figure 15:
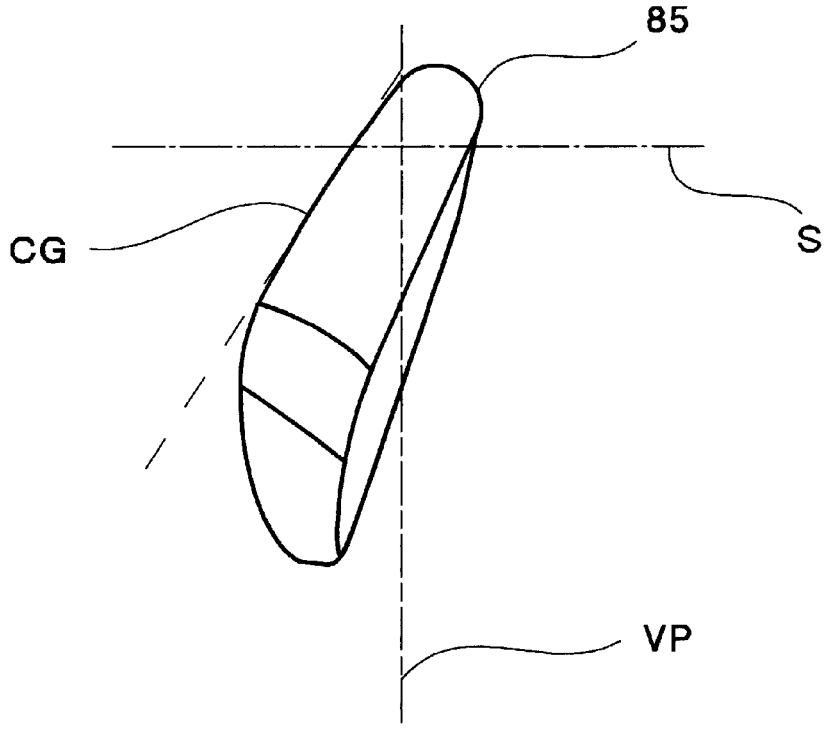
FIGS. 15–17 are views similar to FIGS. 13 and 14.
Figure 16:
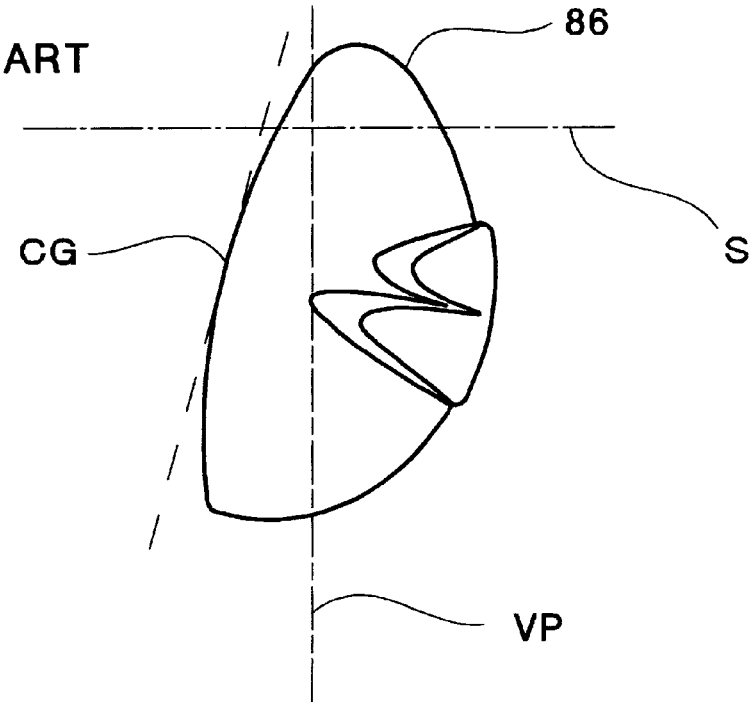
FIG.16 PRIOR ART
Figure 17:
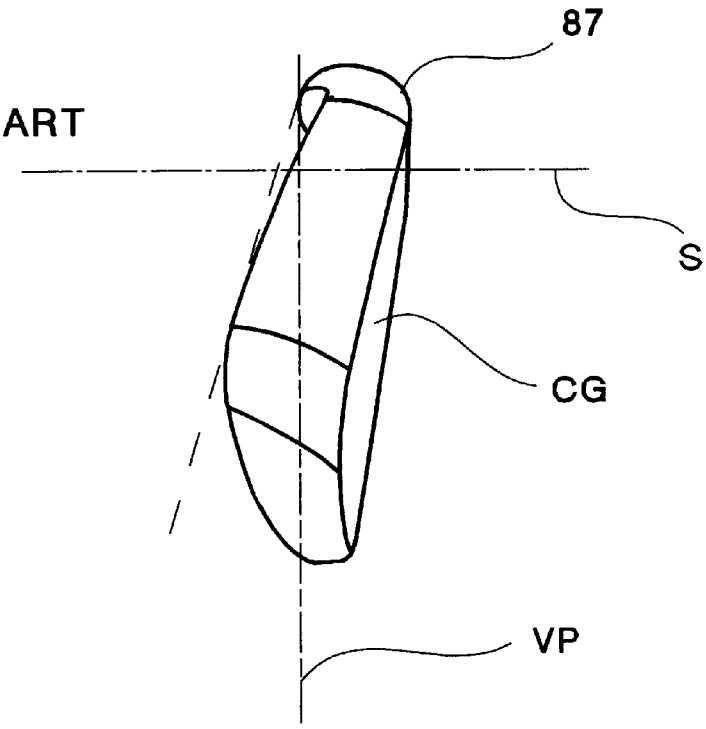
FIG.17 PRIOR ART
Figure 18:
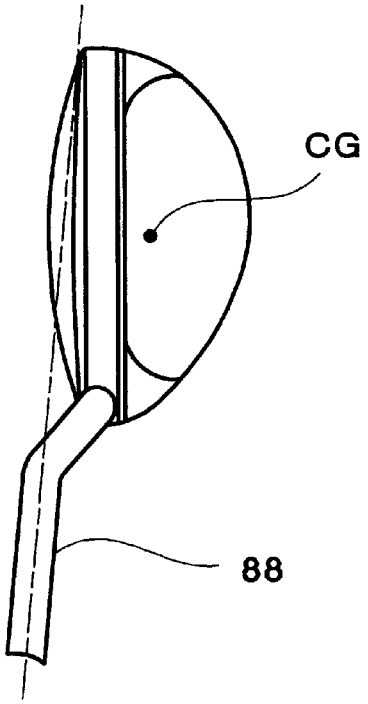
FIGS. 18 and 19 illustrate tendency of a golf club with a curved shaft to square the club face during the downswing.
Figure 19:
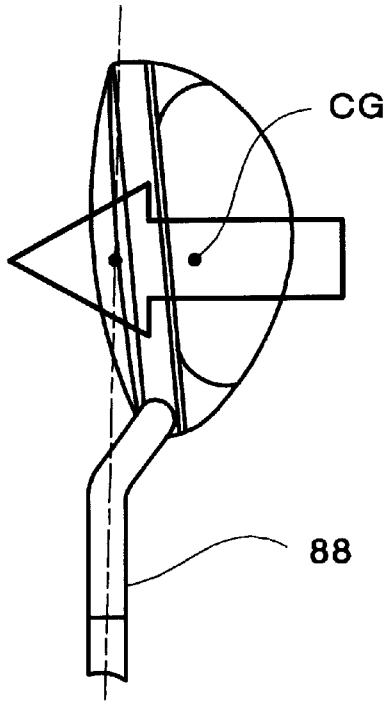

FIGS. 15–17 illustrate an iron golf club 85 with prior art golf clubs 86 and 87 with straight shafts. Golf club 86 is a utility club with face progression. Golf club 87 is an offset club. In each case the center of gravity CG of the clubhead is positioned to the right of vertical plane. The angle of the center of gravity for each club is less than for the club 82 with the curved shaft.

In the golf swing the face of the golf club is fanned open during the backswing. On the downswing the golfer must square the face of the clubhead by the time that the face contacts the golf club. If the face is still open at impact, the ball will slice.

The greater angle of the center of gravity which is provided by the curved shaft of the invention makes is easier for an average golfer to square the face at the moment of impact and thereby reduces the tendency to slice.

Table 1 provides information for four 5 iron golf clubs which included curved shafts and a conventional Wilson Fat Shaft 5 iron with a straight UST Fat Shaft (the control club). The clubhead for each shaft was a standard Wilson Fat Shaft 5 iron.

TABLE 1

| SHAFT | | | | | |
|---|---|---|---|---|---|
| Manufacturer | Model | CPM | Deflection | Weight | Torque |
| HST | V2.0 | 226 | 4.3" | 73 | 2.6 |
| Aldila | Intermediate Modulus | 232 | 4.4" | 70 | 1.6 |
| Aldila | Low Modulus | 238 | 4.1" | 66 | 1.7 |
| Aldila | High Modulus | 242 | 4.0" | 70 | 1.1 |
| UST | Fat Shaft | 248 | 3.8" | 77 | 1.6 |

| HEAD | | |
|---|---|---|
| Loft | Lie | Head Wt. |
| 25 | 61 | 255 |
| 25 | 61 | 255 |
| 25 | 61 | 255 |
| 25 | 61 | 255 |
| 25 | 61 | 255 |

TABLE 1-continued

| CLUB | | |
|---|---|---|
| Swing Wt. | Length | Frequency |
| D2 | 38.5 | 259 |
| D1.5 | 38.5 | 249 |
| D1.5 | 38.5 | 258 |
| D1.5 | 38.5 | 270 |
| D2 | 38.5 | 270 |

An Iron Byron mechanical golfer was set-up to nominal 5 iron launch conditions with the control club. A standard three point test (Heel/Center/Toe) was used to evaluate the stability aspects of the curved shaft designs as compared to the control club. The curved shaft clubs were placed in the machine after the control club was evaluated, and the face angle adjusted to achieve a straight ball flight. The tee was not adjusted forward/back in the stance, but slight adjustments were made in the up/down and in/out directions to achieve a central ball impact at the midpoint of the 5th scoreline. The three points were hit alternately in a line-by-line fashion (Center, Heel, Toe).

All of the Aldila shafts broke during the set-up portion of the testing. It was not the intention to continue to break all of the shafts, but a result of the sequence of testing (i.e., testing order 1. Control; 2. Aldila Low Mod; 3. Aldila Int. Mod; 4. HST V2.0; 5-Aldila High Mod). The failures of the Aldila shafts were quite peculiar and unexplainable in that they broke in the middle of the shaft and sometimes into multiple pieces. These Aldila shafts were observed to have an oval shaft cross-sectional as compared to the seemingly round cross-section shape of the HST V2.0.

Figure 20:
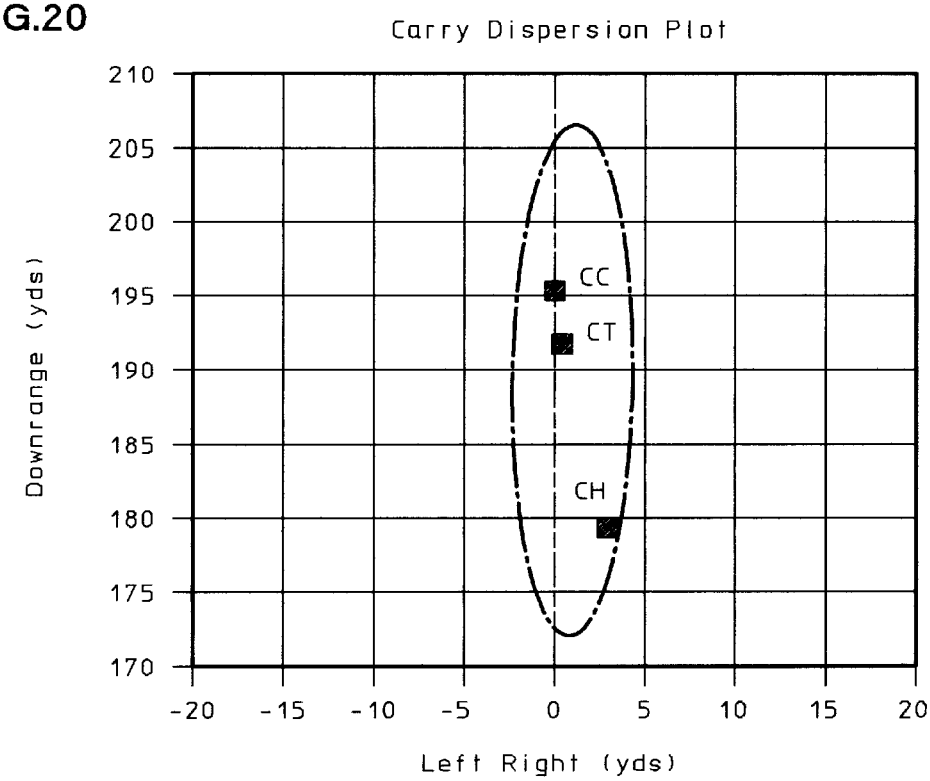
FIG. 20 is a dispersion plot of the landing points of golf balls which were struck with a 5 iron having a straight shaft.
Figure 21:
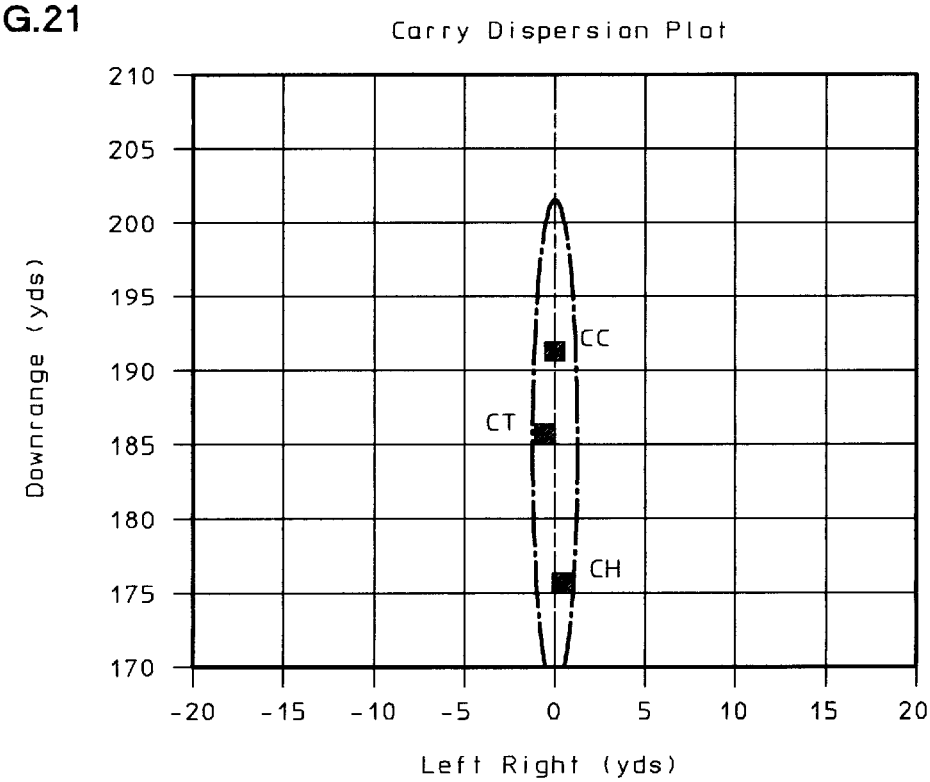
FIG. 21 is a dispersion plot of landing points with golf balls which were struck with a 5 iron having a curved shaft.

The results of the tests for the control club and for the club with the HST V2.0 club are tabulated in Tables 2 and 3 and illustrated in FIGS. 20 and 21, respectively.

TABLE 2

| Wilson Golf RTF Test Report UST FS Control Club | | | | | | | | |
|---|---|---|---|---|---|---|---|---|
| Location | | | Launch Angle (deg) | Ball Velocity (fps) | Back Spin (rpm) | Carry Distance (yds) Adj Center Line | Left/Right of Center (yds) Adj Center Line | SAA (sq yds) |
| CENTER CENTER | CC | Avg | 14.8 | 189.2 | 3544 | 195.9 | 0.0 | 207 |
| (0.000, 0.000) | | St Dev | 0.2 | 1.0 | 179 | 2.5 | 6.7 | |
| CENTER HEEL | CH | Avg | 14.9 | 178.1 | 3084 | 179.4 | 3.0 | 230 |
| (0.6875, 0.000) | | St Dev | 0.3 | 0.8 | 178 | 4.0 | 4.6 | |
| CENTER TOE | CT | Avg | 15.0 | 184.6 | 3464 | 192.2 | 0.3 | 199 |
| (−0.6875, 0.000) | | St Dev | 0.2 | 0.8 | 177 | 2.8 | 5.6 | |
| COMPOSITE | ALL | Avg | 14.9 | 183.9 | 3364 | 189.1 | 1.1 | 183 |
| | | St Dev | 0.1 | 5.6 | 246 | 8.7 | 1.7 | |

Set-Up Notes:
1. Average clubspeed = 128 ft/sec or 87.2 MPH
2. Smartcore Spin Distance Control Balls marked SET-UP (N = 12 per pt.)
3. 3 pt Test w/ Auto-Tee
4. CC located on mid point of 5th Scoreline
5. Grid Spacing: 0.6875" Horizontal
6. Frezzi Lighting: 2nd WTAS System
7. Conditions: Afternoon, 95 degrees F., 4 to 9 mph Tail Right to Left.

TABLE 3

| Wilson Golf RTF Test Report HST V2.0 | | | | | | | | |
|---|---|---|---|---|---|---|---|---|
| Location | | | Launch Angle (deg) | Ball Velocity (fps) | Back Spin (rpm) | Carry Distance (yds) Adj Center Line | Left/Right of Center (yds) Adj Center Line | SAA (sq yds) |
| CENTER CENTER | CC | Avg | 14.4 | 187.7 | 3925 | 191.8 | 0.0 | 217 |
| (0.000, 0.000) | | St Dev | 0.3 | 0.6 | 195 | 3.4 | 5.2 | |
| CENTER HEEL | CH | Avg | 14.0 | 174.8 | 3523 | 175.7 | 1.1 | 121 |
| (0.6875, 0.000) | | St Dev | 0.2 | 0.7 | 197 | 2.2 | 4.4 | |
| CENTER TOE | CT | Avg | 14.4 | 183.8 | 4145 | 186.4 | −0.9 | 173 |
| (−0.6875, 0.000) | | St Dev | 0.2 | 0.8 | 225 | 2.7 | 5.1 | |
| COMPOSITE | ALL | Avg | 14.3 | 182.1 | 3864 | 184.6 | 0.1 | 101 |
| | | St Dev | 0.2 | 6.6 | 316 | 8.2 | 1.0 | |

Set-Up Notes:
1. Average clubspeed = 128.5 ft/sec or 87.6 MPH
2. Smartcore Spin Distance Control Balls marked SET-UP (N = 12 per pt.)
3. 3 pt Test w/ Auto-Tee
4. CC located on mid point of 5th Scoreline
5. Grid Spacing: 0.6875" Horizontal
6. Frezzi Lighting: 2nd WTAS System
7. Conditions: Afternoon, 95 degrees F., 4 to 9 mph Tail Right to Left.

Comparing FIGS. 20 and 21, the narrower dispersion plot for the HST V2.0 curved shaft club indicates that that club has greater torsional stability than the control club. The curved shaft has greater torsional stability even though the torque of the curve shaft is greater than the torque of the control shaft (2.6 v. 1.8), which means that the curved shaft has less resistance to twisting than the control shaft.

Figure 22:
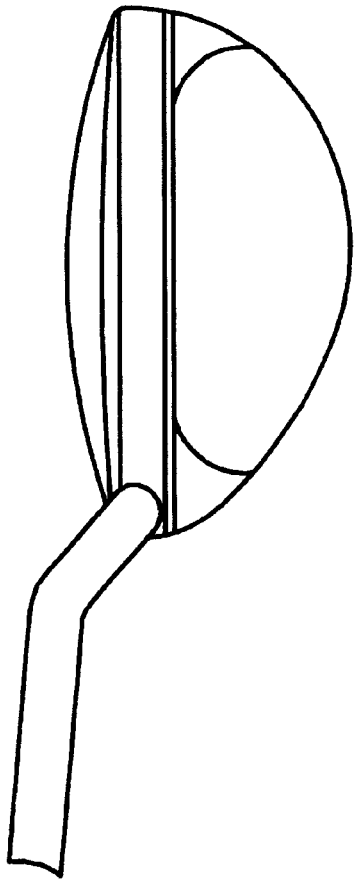
FIG. 22 is a top view of a golf club with a curved shaft.
Figure 23:
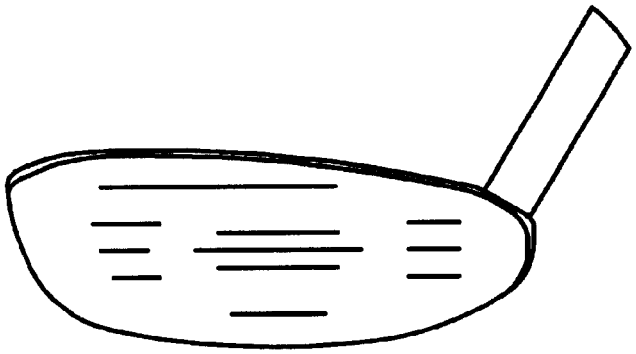
FIG. 23 is a front view of the golf club of FIG. 22.
Figure 24:
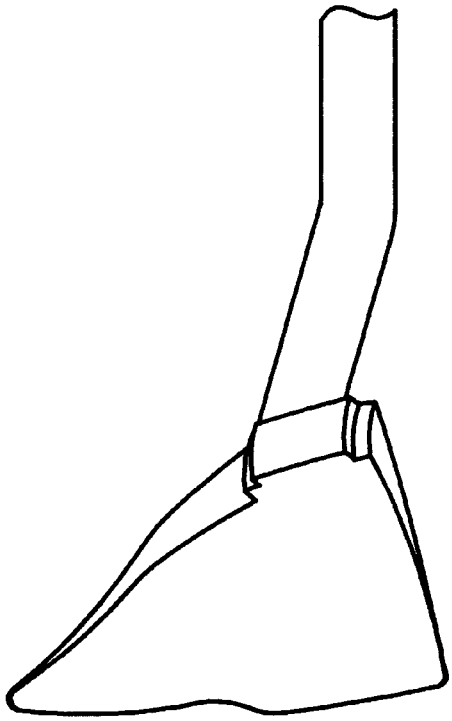
FIG. 24 is a toe view of the golf club of FIG. 22.
Figure 25:
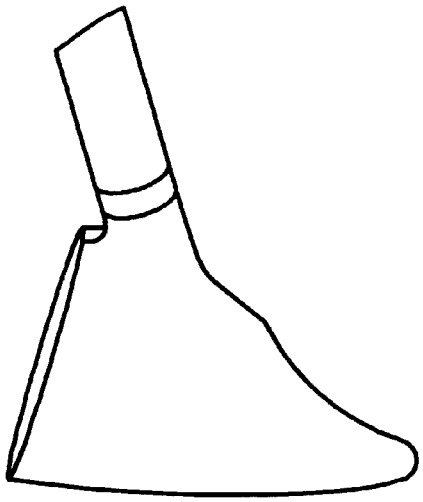
FIG. 25 is a heel view of the golf club of FIG. 22.

FIGS. 22–25 illustrate a hybrid golf club 90, i.e., a golf club which has attributes of both a wood an iron, with a curved shaft. FIG. 22 is a top view of the club in the address position. FIG. 23 is a front view, and FIGS. 24 and 25 are toe and heel views, respectively.

While in the foregoing specification a detailed description of specific embodiments of the invention has been set forth for the purpose of illustration, it will be understood that many of the details hereingiven can be varied considerably by those skilled in the art without departing from the spirit and scope of the invention.

I claim:

1. A golf club comprising a clubhead and an elongated shaft attached to the clubhead, the clubhead having a center of gravity, a sole portion having a midportion which is adapted to contact a horizontal ground plane when the clubhead is soled in an address position on the ground plane, a front striking face with a bottom leading edge having a midportion which is tangent to a first vertical plane when the clubhead is in said address position, the front face having a center which lies in a second vertical plane which is perpendicular to said first vertical plane, a toe portion, a heel portion, and a hosel extending from the heel portion, the shaft having a relatively long butt portion having a butt end and a center axis and a relatively short tip portion having a tip end and a center axis which extends at an angle relative to the axis of the butt portion, the tip portion of the shaft being attached to the hosel and the axis of the tip portion extending at an acute angle relative to said first vertical plane forwardly from the center of gravity of the clubhead, the butt portion and tip portion of the shaft being positioned so that when the club is viewed from a vertical plane parallel to said first vertical plane, the axis of the butt portion extends at an angle from said second vertical plane and the axis of the tip portion extends at a smaller angle from said second vertical plane, the axis of the butt portion lying in a third vertical plane when the clubhead is in said address position.

2. The golf club of claim 1 in which said third vertical plane is in front of and parallel to said first vertical plane.

3. The golf club of claim 1 in which the angle between the axes of the butt portion and the tip portion is about 1 to 90°.

4. The golf club of claim 1 in which the angle between the axes of the butt portion and the tip portion is about 18°.

* * * * *